United States Patent [19]

Huard

[11] 4,089,459

[45] May 16, 1978

[54] COIN WRAPPER

[76] Inventor: Albert Huard, 6676 St. Denis St. apt. 1, Montreal, Quebec, Canada

[21] Appl. No.: 804,128

[22] Filed: Jun. 6, 1977

[51] Int. Cl.[2] ..... B65D 65/10; B65D 65/16

[52] U.S. Cl. ..... 229/87.2; 138/128; 206/.82; 229/4.5; 229/93; 229/DIG. 3

[58] Field of Search ..... 229/DIG. 3, 87.2, 93, 229/4.5, 21; 138/128; 206/.8–.84

[56] References Cited

U.S. PATENT DOCUMENTS

| | | | |
|---|---|---|---|
| 673,373 | 4/1901 | Youmans | 229/87.2 |
| 2,140,996 | 12/1938 | Heifetz | 229/4.5 |
| 2,266,547 | 12/1941 | Goodwin | 229/87.2 |
| 3,092,304 | 6/1963 | Kerrell | 229/87.2 |
| 3,420,359 | 1/1969 | Cochrane | 206/.82 |

*Primary Examiner*—Stephen P. Garbe

[57] ABSTRACT

The disclosure relates to a coin wrapper comprising a sheet of transparent flexible material. The sheet can be snapped to enable it to be formed into a cylinder with predetermined dimensions. Inner circular ridges are provided near both ends of the cylinder to retain coins therein.

3 Claims, 4 Drawing Figures

COIN WRAPPER

This invention relates to a coin wrapper. More particularly, the invention relates to a transparent, quick, snap on coin wrappers. Basically, what is now available is the standard paper wrapper where a person has to roll money into coin rolls. Also, there are provided automatic devices which are very expensive and are not so practical for every day use.

In order to overcome the above disadvantage, I have provided a coin wrapper comprising a sheet of transparent flexible material, snapping means in the sheet to enable it after it has been rolled upon itself to be formed into a cylinder with predetermined dimensions, and means in the sheet defining inner circular ridges near both ends of the cylinder to retain coins inside the cylinder.

The invention will now be illustrated by means of the following drawings in which.

Figure 1:
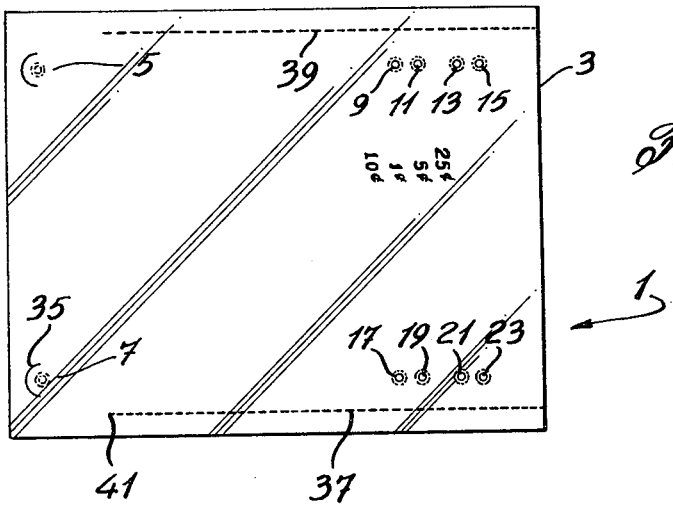
FIG. 1 is a view of the coin wrapper according to the invention as laid before wrapping coins therewith.

Referring to the drawings, the coin wrapper 1 according to the invention consists of a sheet of transparent flexible plastic material 3. The idea is to have a coin wrapper which can easily be snapped and for this purpose, there are provided male parts 5 and 7 on one face of the sheet of transparent plastic material (in FIG. I the male parts will be underneath the sheet 1) and the female parts 19, 11 13, 15 and 17, 19, 21, 23, on the other face.

Figure 4:
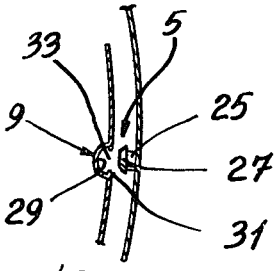
FIG. 4 is an enlarged view of the snapping means used to snap the coin wrapper.

The male and female parts are better illustrated in FIG. 4 of the drawings which show only male part 5 and female part 9. The male part, as shown, consists of a stud 25 which is terminated by an enlarged head 27. On the other hand, the female part consists of a substantially spherical depression 29 which has a rim 31 in the opening 33 thereof. It will be realised that once the stud 25 and its head 27 are snapped into the depression 29, the rim 31 will hold the head firmly into the depression and prevent it from being unsnapped therefrom.

In practice, there are provided four female parts for each male part. The reason is that the wrapper must be adapted to form cylinders of varying dimensions depending on whether pennies, nickels, dimes and quarters are intended to be packed.

Since the snapping means formed by the male parts 5, 7 and the female parts 9, 11, 13, 15 and 17, 19, 21, 23 are made of the plastic material with which the coin wrapper is made, they are very delicate and for all practical purposes, they should not be considered to be reusable.

Figure 2:
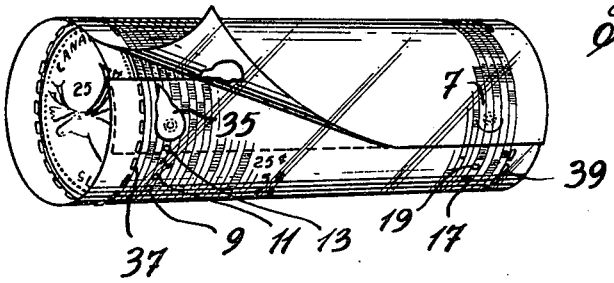
FIG. 2 is a view of a roll of coins wrapped into the wrapper according to the invention, also showing a part which has been torn away when unsnapping the roll of coins.
Figure 3:
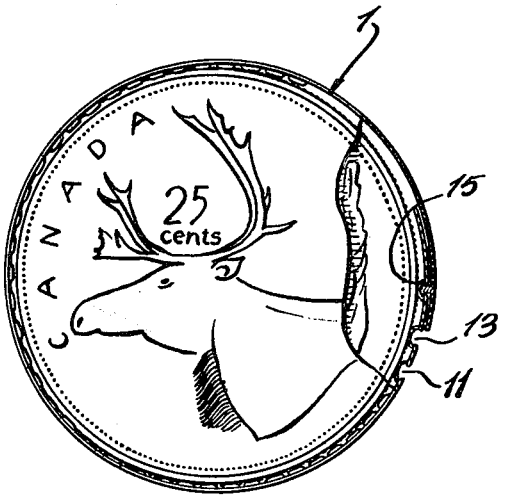
FIG. 3 is a view from one end of a roll of coins using the wrapper according to the invention.

Instead of running the risk of persons trying to reuse the wrapper according to the invention and having problems with it, the male parts are held onto the female parts when unsnapping the wrapper. This is made possible by providing a substantially half circular cut 35 through the transparent material around the male part all as shown in FIGS. 1 and 2 of the drawings. Therefor, if one tries to unsnap the coin wrapper, the tear line 35 will cause a complete tear around the male part with the result that the coin wrapper will be unusable.

Finally, in order to hold the coins in place inside the cylinder formed by the coin wrapper and to make sure that the correct number of coins are used, there are provided inner ridges 37, 39 which are formed by debossing the sheet 1 along parallel lines running from one end of the sheet as shown in FIG. 1 where the female parts are provided to a point 41 short of the male part at the other end of the sheet.

The various parts, including the production of the female and male parts, i.e. depressions and rims, and studs and heads, can be made by any means known to the man of the art such as by straight debossing and molding or by the additions of male parts, rims and inner ridges unto the sheet of transparent plastic material.

The wrapper will be very easy to use, it is merely sufficient to put a sufficient number of coins to fill the space between the ridges 37 and 39 and to close the wrapper and snap the male parts into the female parts.

Of course, various modifications can be made without departing from the spirit of the present invention. For example, the shapes of the female and male parts can vary at great length. The number of male parts and female parts can also vary although it is preferable to use a pair of male parts. The ridges can extend all around the inner side of the roll or they can be just merely sufficient to hold the coins inside the cylinder.

The inner ridge can consist of a number of small debossed dense 37, 39 or could consist of a continuous debossed line inside the cylinder.

The wrapper can be constructed to be reusable.

I claim:

1. A coin wrapper comprising a sheet of transparent flexible material, a pair of studs formed near one end of said sheet on one face thereof, each stud being terminated by an enlarged head, four substantially spherical depressions for each stud, each of said depressions having a rim in the opening, said rim to hold one of said heads firmly into said depression after snapping one of said studs into one of said depressions said four depressions for each stud being all in line with said stud, said depressions being adapted to engage said studs to form a cylinder with four diametrical dimensions so that said cylinder is capable of holding pennies, nickels, dimes or quarters, and means to cause tearing of the material surrounding each of said studs upon trying to unsnap said coin wrapper.

2. A coin wrapper according to claim 1, where said tearing means comprise a substantially half circular cut through said transparent material around each of said studs.

3. A coin wrapper according to claim 2, which comprises inner ridges formed by debossing said sheet along parallel lines running from one end of said sheet where one group of four depressions are provided to a point at the other end of said sheet short of a corresponding stud.

* * * * *